United States Patent [19]

Taguchi et al.

[11] Patent Number: 4,954,478

[45] Date of Patent: Sep. 4, 1990

[54] THERMAL DYE TRANSFER SHEET

[75] Inventors: Nobuyoshi Taguchi; Akihiro Imai, both of Ikoma; Yukichi Murata, Sagamihara; Takao Hirota, Machida, all of Japan

[73] Assignees: Matsushita Electric Industrial Co. Ltd.; Mitsubishi Kasei Corporation, both of Japan

[21] Appl. No.: 276,420

[22] Filed: Nov. 23, 1988

[30] Foreign Application Priority Data

Nov. 25, 1987 [JP] Japan ..... 62-296453

[51] Int. Cl.[5] ..... B41M 5/035; B41M 5/26

[52] U.S. Cl. ..... 503/227; 8/471; 428/195; 428/216; 428/335; 428/336; 428/913; 428/914

[58] Field of Search ..... 8/471; 428/195, 913, 428/914, 216, 335, 336; 503/227

[56] References Cited

FOREIGN PATENT DOCUMENTS 216483 4/1987 European Pat. Off. ..... 503/227
2159971 12/1985 United Kingdom ..... 503/227

OTHER PUBLICATIONS

Patent Abstracts of Japan, vol. 8, No. 189 (M-321) [1626] 8/30/84 JPA-59-78896 (5/7/84).
Patent Abstracts of Japan, vol. 11, No. 86 (M-572) [2533] 3/17/87 JPA 61-241 191 (10/27/86).

*Primary Examiner*—Bruce H. Hess
*Attorney, Agent, or Firm*—Jordan B. Bierman

[57] ABSTRACT

A thermal magenta-dye transfer sheet that comprises a base film having thereon a dye layer comprising a magenta-dye dispersed in a binder which is mixture of two dyes represented by the general formulas (I) and (II):

(I)

(where X is a hydrogen atom, a lower alkyl group, a lower alkoxy group, a formylamino group, a lower alkylcarbonylamino group, a lower alkylsulfonylamino group or a lower alkoxy-carbonylamino group; Y is a hydrogen atom, a lower alkyl group, a lower alkoxy group or a halogen atom; and $R^1$, $R^2$ and $R^3$ each represents a hydrogen atom, a substituted or unsubstituted alkyl group, a cycloalkyl group, an allyl group or a substituted or unsubstituted aryl group); and (II)

Z is a hydrogen atom or a lower alkyl group; and $R^4$ and $R^5$ each represents a hydrogen atom, a substituted or unsubstituted alkyl group, a cycloalkyl group, an allyl group, or a substituted or unsubstituted aryl group, and $R^4$ may also form a heterocyclic 6-membered ring by being bonded to a carbon atom adjacent to the carbon binding to the nitrogen atom which is bonded to the benzene ring).

19 Claims, 1 Drawing Sheet

THERMAL DYE TRANSFER SHEET

DETAILED DESCRIPTION OF THE INVENTION

1. Field of Invention

The present invention relates to a transfer sheet useful in thermal sublimable dye transfer recording. The present invention more particularly relates to a magenta-color developing thermal sublimable dye transfer sheet.

2. Prior Art

In order to meet the need for obtaining color records with facsimile printers and copying machines or from TV pictures, various color recording techniques are under review, including those based on electrophotography, ink-jet printing and thermal transfer.

The thermal transfer recording system involves easy maintenance and operation of the equipment. In addition, the apparatus and consumable supplies used with this system are inexpensive. It is therefore held to be advantageous over the other color recording systems.

The thermal transfer recording system is divided into two types: one is of a melting type in which a transfer sheet having a heat-fusible ink layer formed on a base film is heated with a thermal head so that the ink is fused in an imagewise pattern and transferred onto a recording element; the other is of a sublimation type in which a transfer sheet having a sublimable dye containing ink layer formed on a base film is heated with a thermal head so that the dye is allowed to sublime in an imagewise pattern and transferred onto a recording element. In the recording of the sublimation type, the amount in which the dye sublimes and forms a transfer image can be controlled by changing the energy to be imparted to the thermal head and this facilitates the recording of an image in gradation. This system is therefore considered to be of particular advantage for the purpose of full-color recording.

In thermal transfer recording of the sublimation type, the sublimable dye which is used in the transfer sheet bears great importance since it causes substantial effects on such factors as the speed of transfer recording, the quality of a record and its storage stability. The sublimable dye to be incorporated in the transfer sheet are therefore required to satisfy the following conditions:

(1) it should readily sublime under the operating conditions of a thermal recording head;

(2) it should not decompose thermally under the operating conditions of the thermal recording head;

(3) it should be capable of reproducing a desired color;

(4) it should have a high molecular extinction coefficient;

(5) it should be stable against heat, light, moisture and chemicals;

(6) it should be easy to synthesize;

(7) it should have good adaptability for preparing ink formulations; and (8) it should cause no safety or hygienic problems.

The dyes represented by the general formulas (I) and (II) which are to be used in the present invention are both capable of forming a bright magenta color and thermal transfer sheets using them individually are already known. For example, some of the dyes of the general formula (I) are disclosed as thermal transfer dyes in JP-A-61-227091 (the term "JP-A" as used herein means an "unexamined published Japanese patent application"). Some of the dyes of the general formula (II) are also disclosed as thermal transfer dyes in such prior patent applications as JP-A-60-31564, JP-A-60-28452, JP-A-60-31563, and JP-A-60-223862. A method of thermal transfer recording that employs some of these dyes on their own are disclosed in U.K. Patent No. 1551561.

Thermal transfer sheets that use imidazoleazo dyes of general formula (I) alone are capable of producing records having very high storage stability but on the other hand, their sensitivity is low and great energy is required to attain adequate recording density. In contrast, thermal transfer sheets that use tricyanovinyl dyes of general formula (II) alone have very high sensitivity and need only low energy to produce satisfactory recording density. However, the records produced from these sheets are low in keeping stability, especially in lightfastness.

SUMMARY OF THE INVENTION

An object, therefore, of the present invention is to provide a thermal magenta-dye transfer sheet that has a sufficiently high sensitivity to permit transfer recording with low energy and which produces a record having high keeping stability by virtue of the use of a dye layer containing a mixture of dyes represented by the general formulas [I] and [II] to be described herein.

In accordance with the present invention, two dyes are used in such a combination that, when incorporated in the same dye layer, they exhibit their own characteristics effectively without impairing each other's characteristics. By employing such dyes, the present invention is capable of providing an improved thermal dye transfer sheet.

DETAILED DESCRIPTION OF PREFERRED EMBODIMENTS

Figure 1:
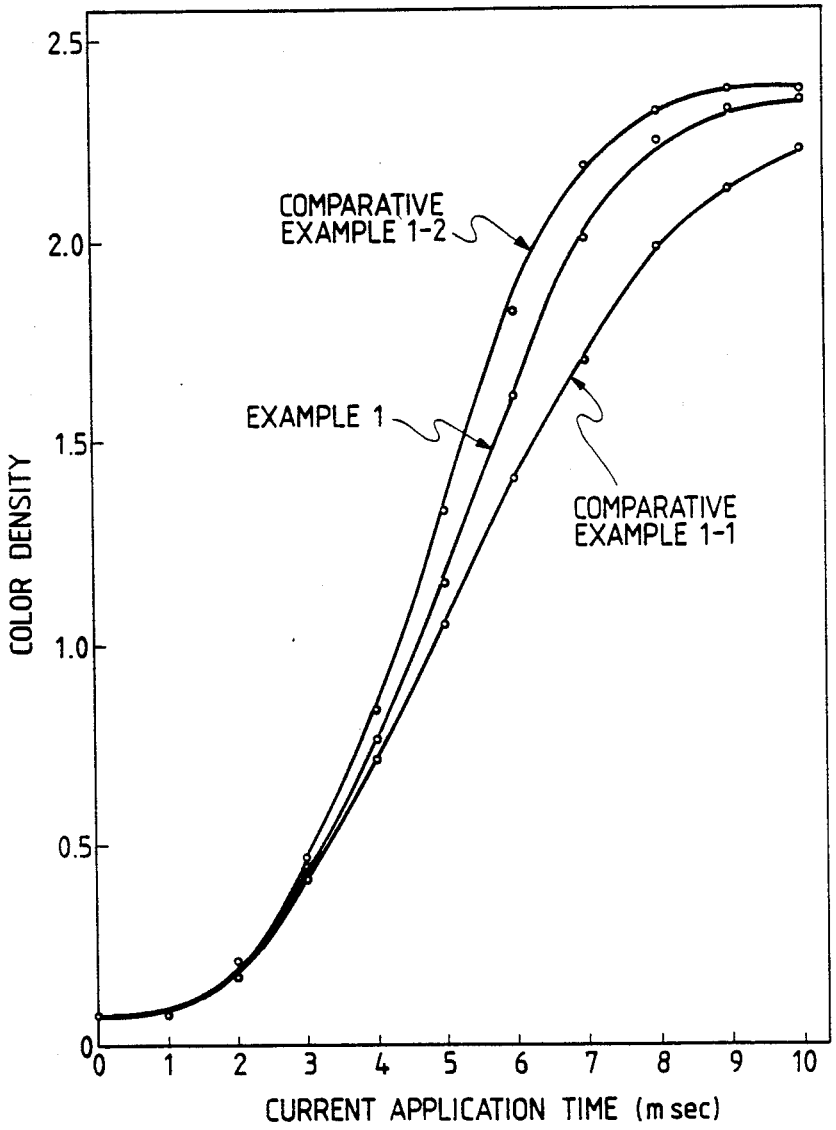
FIG. 1 is a graph showing the recording characteristics that were obtained when thermal recording was conducted with the transfer sheets prepared in Examples 1 as well as in Comparative Examples 1-1 and 1-2 and 3. In the diagram, the vertical axis plots color density, and the horizontal axis plots the duration of time in milliseconds for which an electric current was applied to the thermal head.

The essence of the present invention lies in a thermal magenta-dye transfer sheet that comprises a base film having thereon a dye layer comprising a magenta dye dispersed in a binder, said dye being a mixture of dyes represented by the following general formulas (I) and (II):

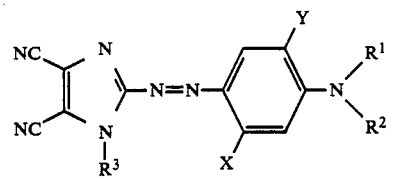

(I)

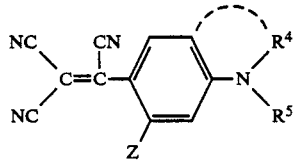

(II)

In formula (I), X is a hydrogen atom, a lower alkyl group, a lower alkoxy group, a formylamino group, a lower alkylcarbonyl-amino group, a lower alkylsulfonylamino group or a lower alkoxy-carbonylamino group; Y is a hydrogen atom, a lower alkyl group, a lower alkoxy group or a halogen atom; and $R^1$, $R^2$ and $R^3$ each represents a hydrogen atom, a substituted or unsubstituted alkyl group, a cycloalkyl group, an allyl group or a substituted or unsubstituted aryl group.

In formula (II), Z is a hydrogen atom or a lower alkyl group; and $R^4$ and $R^5$ each represents a hydrogen atom, a substituted or unsubstituted alkyl group, a cycloalkyl group, an allyl group, or a substituted or unsubstituted aryl group, and $R^4$ may also form a heterocyclic 6-membered ring by being bonded to a carbon atom adjacent to the carbon binding to the nitrogen atom which is bonded to the benzene ring.

Preferred embodiments of the present invention are described hereinafter in detail.

Examples of the lower alkyl group and lower alkoxy group as substituents X, Y and Z in the general formulas (I) and (II) include linear or branched alkyl and alkoxy groups of $C_{1-4}$. Examples of the lower alkyl and lower alkoxy groups in the lower alkylcarbonylamino group, lower alkylsulfonylamino group and the lower alkoxycarbonylamino group, each being represented by X, include linear or branched alkyl and alkoxy groups of $C_{1-4}$. Examples of the halogen atom as Y include fluorine and chlorine atoms.

Examples of the unsubstituted alkyl group denoted by each of $R^1$–$R^5$ in general formulas (I) and (II) include linear or branched alkyl groups of $C_{1-12}$; examples of the substituted alkyl group include linear or branched alkyl groups of $C_{1-12}$ that are substituted by alkoxy, alkoxyalkoxy, aryloxy, allyloxy, aralkyloxy, aryl, cyano, hydroxy, halogen atom, furyl, tetrahydrofuryl, alkoxycarbonyl, allyloxycarbonyl, acyloxy, etc.

Examples of the alkoxy-substituted alkyl group include: 2-methoxyethyl, 2-ethoxyethyl, 2-(n)propoxyethyl, 2-(iso)propoxyethyl, 2-(n)butoxyethyl, 2-(iso)-butoxyethyl, 2-(sec)butoxyethyl, 2-(n)pentyloxyethyl, 2-(n)hexyloxyethyl, 2-(n)octyloxyethyl, 2-(2'-ethylhexyloxy)ethyl, 1-methyl-2-methoxyethyl, 1-methyl-2-ethoxyethyl, 1-methyl-2-(n)propoxyethyl, 1-methyl-2-(iso)propoxyethyl, 1-methyl-2-(n)butoxyethyl, 1-methyl-2-(iso)butoxyethyl, 1-methyl-2-(n)hexyloxyethyl, 1-methyl-2-(2'-ethylhexyloxy)ethyl, 3-methoxybutyl, 3-ethoxybutyl, 1-ethyl-2-methoxyethyl, and 1-ethyl-2-ethoxyethyl. Among these alkoxy-substituted alkyl groups, β-alkoxyethyl groups of $C_{3-8}$ are particularly preferred.

Examples of the aralkyloxy-substituted alkyl group include: 2-benzyloxyethyl, 1-methyl-2-benzyloxyethyl, 1-ethyl-2-benzyloxyethyl, and 2-(β-phenylethyl)oxyethyl.

Examples of the allyloxy-substituted alkyl group include: 2-allyloxyethyl, 1-methyl-2-allyloxyethyl, and 1-ethyl-2-allyloxyethyl.

Examples of the aryloxy-substituted alkyl group include: 2-phenoxyethyl, 1-methyl-2-phenoxyethyl and 1-ethyl-2-phenoxyethyl.

Examples of the alkoxyalkoxy-substituted alkyl group include: 2-(2'-methoxyethoxy)ethyl, 2-(2'-ethoxyethoxy)ethyl, 2-[2'-(n)butoxyethoxy]ethyl, 2-[2'-(n)-hexyloxyethoxy]ethyl, 2-[2'-(n)-octyloxyethoxy]ethyl, 2-[2'-(iso)-butoxyethoxy]ethyl, 1-methyl-2-(2'-methoxyethoxy)ethyl, 1-methyl-2-[2'-(n)butoxyethoxy]ethyl, and 3-(2'-methoxy-ethoxy)butyl. Among these alkoxyalkoxy-substituted alkyl groups, β-(β'-alkoxyethoxy)ethyl groups of $C_{5-10}$ are particularly preferred.

Examples of the cyano-substituted alkyl group include 2-cyanoethyl and cyanomethyl; examples of the hydroxy-substituted alkyl group include 2-hydroxyethyl, 3-hydroxy(n)propyl, 4-hydroxy(n)butyl, 1-methyl-2-hydroxyethyl and 1-ethyl-2-hydroxyethyl; examples of the halogen-substituted alkyl group include 2-chloroethyl, 2-bromoethyl and 2,2,2-trifluoroethyl; examples of the furyl-substituted alkyl group include furfuryl; example of the tetrahydrofuryl-substituted alkyl group include tetrahydrofurfuryl; examples of the aryl-substituted alkyl group include benzyl, p-chlorobenzyl, and 2-phenylethyl.

Examples of the alkoxycarbonyl- or allyloxycarbonyl-substituted alkyl group include: 2-methoxycarbonylethyl, 2-ethoxycarbonylethyl, 2-(iso)butoxycarbonylethyl, 2-(n)hexyloxycarbonyl, 1-methyl-2-methoxy-carbonylethyl, 1-methyl-2-(n)butoxycarbonylethyl, 2-allyloxycarbonylethyl, 1-methyl-2-allyloxycarbonylethyl, methoxycarbonylmethyl, ethoxycarbonylmethyl, (iso)butoxycarbonylmethyl, (n)hexyloxycarbonylmethyl, and 2-ehtylhexyloxycarbonylmethyl.

Examples of the acyloxy-substituted alkyl group include: 2-acetoxyethyl, 2-propionyloxyethyl, 2-benzoyloxyethyl, 3-acetoxy(n)propyl, 4-acetoxy(n)butyl, 1-methyl-2-acetoxyethyl, and 1-ethyl-2-acetoxyethyl.

Examples of the cycloalkyl group denoted by each of $R^1$ to $R^5$ in general formulas (I) and (II) include cyclopentyl and cyclohexyl.

The substituted or unsubstituted aryl group denoted by each of $R^1$ to $R^5$ in general formulas (I) and (II) may be a substituted or unsubstituted phenyl group. Illustrative substituents include a lower alkyl group of $C_{1-4}$, a lower alkoxy group of $C_{1-4}$, a halogen atom such as a fluorine, chlorine or bromine atom, and a trifluoromethyl group.

Preferred examples of the dyes represented by the general formula (I) are those wherein X is a hydrogen atom, a methyl group, a methoxy group, a formylamino group or an alkylcarbonyl-amino group of $C_{2-5}$; Y is a hydrogen atom; $R^1$ and $R^2$ each represents an allyl group, an alkyl group of $C_{1-8}$, a benzyl group, a phenethyl group, an alkyl group of $C_{2-8}$ which is substituted by a hydroxyl group, a halogen atom or a cyano group or an alkoxyalkyl group of $C_{3-8}$; and $R^3$ is an alkyl group of $C_{1-8}$, an allyl group, a cyanomethyl group, a cyanoethyl group, an alkoxycarbonylmethyl group having an alkoxy group of $C_{1-8}$, or an alkoxycarbonylethyl group having an alkoxy group of $C_{1-8}$. More preferred examples of the dyes represented by the general formula (I) are those wherein X is an acetylamino group or a formylamino group; Y is a hydrogen atom; $R^1$ and $R^2$ each represents an alkyl group of $C_{1-8}$ or an alkoxyalkyl group of $C_{3-8}$; and $R^3$ is an alkyl group of $C_{1-8}$, an alkoxyalkyl group of $C_{3-8}$, a cyanomethyl group or an allyl group. Particularly preferred examples are those wherein $R^1$ and $R^2$ are each an alkyl group of $C_{1-8}$ and $R^3$ is an alkyl group of $C_{1-8}$, a cyano-methyl group or an allyl group.

Preferred examples of the dyes represented by the general formula (II) are divided into two types which are represented by the following general formulas (III) and (IV):

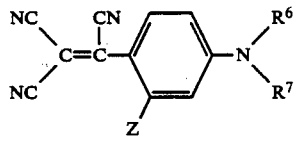

(III)

[where $R^6$ and $R^7$ each representes an alkyl group of $C_{1-12}$ which may be substituted by a cyano group, a halogen atom, an alkoxy group, an alkoxyalkoxy group, an aryloxy group, an allyloxy group, an aralkyloxy group, an aryl group, a hydroxyl group, a furyl group, a tetrahydrofuryl group, an alkoxycarbonyl group, an allyloxycarbonyl group or an acyloxy group, or an allyl group; and Z has the same meaning as defined in formula (II)]; and

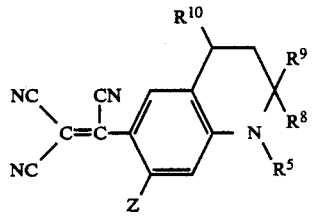

(IV)

[where $R^8$, $R^9$ and $R^{10}$ each represents a hydrogen atom or a methyl group; and Z and $R^5$ have the same meanings as defined in formula (II)].

Preferred examples of the dyes represented by the general formula (III) are those in which Z is a hydrogen atom or a methyl group, and $R^6$ and $R^7$ are each an alkyl group of $C_{1-8}$, an alkoxy-alkyl group of $C_{3-8}$, a benzyl group, or a $\beta$-phenylethyl group. More preferred examples are those wherein Z is an hydrogen atom, and $R^6$ and $R^7$ are each an alkyl group of $C_{1-8}$, an alkoxyalkyl group of $C_{3-8}$, or a $\beta$-phenylethyl group.

Preferred examples of the dyes represented by the general formula (IV) are those in which Z is a hydrogen atom or a methyl group; $R^5$ is an alkyl group of $C_{1-8}$, an alkoxyalkyl group of $C_{3-8}$, a benzyl group or a $\beta$-phenylethyl group; and $R^8$, $R^9$ and $R^{10}$ are each a hydrogen atom or a methyl group. More preferred examples are those wherein Z is a hydrogen atom; $R^5$ is an alkyl group of $C_{1-8}$, an alkoxyalkyl group of $C_{3-8}$ or a $\beta$-phenylethyl group; and $R^8$, $R^9$ and $R^{10}$ are each a hydrogen atom or a methyl group.

The weight ratio of the dye of formula (I) to the dye of formula (II) is preferably within the range of from 1:5 to 5:1, more preferably in the range of from 1:2 to 5:1.

In a preferred embodiment, at least one dye of the general formula (I) wherein X is an acetylamino group or a formylamino group, Y is a hydrogen atom, $R^1$ and $R^2$ are each an alkyl group of $C_{1-8}$ or an alkoxyalkyl group of $C_{3-8}$, and $R^3$ is an alkyl group of $C_{1-8}$, an alkoxyalkyl group of $C_{3-8}$, a cyanomethyl group or an allyl group, is used in combination either with at least one dye of the general formula (III) wherein Z is a hydrogen atom or a methyl group, and $R^6$ and $R^7$ are each an alkyl group of $C_{1-8}$, an alkoxyalkyl group of $C_{3-8}$, a benzyl group or a $\beta$-phenylethyl group, or with at least one dye of the general formula (IV) wherein Z is a hydrogen atom or a methyl group, $R^5$ is an alkyl group of $C_{1-8}$, an alkoxyalkyl group of $C_{3-8}$, a benzyl group or a $\beta$-phenylethyl group, and $R^8$, $R^9$ and $R^{10}$ are each a hydrogen atom or a methyl group.

In a particularly preferred embodiment, at least one dye of the general formula (I) wherein X is an acetylamino group or a formylamino group, Y is a hydrogen atom, $R^1$ and $R^2$ are each an alkyl group of $C_{1-8}$, and $R^3$ is an alkyl group of $C_{1-8}$, a cyanomethyl group or an allyl group, is used in combination with at least one dye of the general formula (III) wherein Z is a hydrogen atom, and $R^6$ and $R^7$ are each an alkyl group of $C_{1-8}$, an alkoxyalkyl group of $C_{3-8}$ or a $\beta$-phenylethyl group.

There is no particular limitation on the method that can be employed to form a dye layer using the above-described dyes in the production of the thermal dye transfer sheet of the present invention. A typical method would proceed as follows; the dyes are either dissolved or dispersed as fine particles in a medium together with a binder to prepare an ink; the ink is then coated on a base film and dried to form a dye layer on the base film. Binders that can be used to prepare inks include water-soluble resins such as cellulose resins, acrylate based resins and starches, as well as resins that are soluble in organic solvents such as acrylic resins, methacrylic resins, polystyrene, polycarbonate, polysulfone, polyether sulfone, polyvinyl butyral, ethyl cellulose, acetyl cellulose, polyesters, and AS resins.

Besides water, the following may be used as media for preparing inks: alcohols such as methyl alcohol, isopropyl alcohol, and isobutyl alcohol; cellosolves such as methyl cellosolve and ethyl cellosolve; aromatics such as toluene, xylene and chlorobenzene; esters such as ethyl acetate and butyl acetate; ketones such as acetone, methyl ethyl ketone, methyl isobutyl ketone and cyclohexanone, chlorinated solvents such as methylene chloride, chloroform and trichloroethylene; ethers such as tetrahydrofuran and dioxane; and other organic solvents such as N,N-dimethylformamide and N-methylpyrrolidone.

Besides the components described above, the ink formulation may contain organic or inorganic nonsublimable fine particles, dispersants, antistatics, anti-blocking agents, antifoaming agents, antioxidants, viscosity modifiers and any other necessary additives.

The base film on which the ink is coated in order to prepare the desired transfer sheet are required to meet many conditions, such as a dense and thin structure for ensuring increased thermal conductivity, high heat resistance, a high smoothness that allows a uniform transfer layer to be coated and which provides improved adhesion to the thermal head, and resistance for running ink through the base film. Suitable base films that satisfy these requirements include very thin sheets of paper such as condenser paper and glassine, and films of highly heat-resistant plastics such as polyesters, polycarbonates, polyamides, polyimides, and polyaramids. These films generally have a thickness in the range of 3 to 50 $\mu$m. Among the base films listed above, polyethylene terephthalate films are particularly advantageous in consideration of such factors as mechanical strength, solvent resistance and economy.

The thermal dye transfer sheet of the present invention basically consists of a base film and a dye layer that is formed on its surface and which contains the dyes of formulas (I) and (II) described above. However, in certain cases where improved running properties with respect to the thermal head and higher heat resistance are required, a heat-resistant lubricating layer may be provided on the back surface of the sheet. This layer may generally be provided by coating a heat-resistant inert inorganic compound (e.g. fine silica particles), a lubricant, a surfactant and any other suitable additives together with a heat-resistant thermoplastic resin, thermosetting resin or photocurable resin. According to a typical method, a polycarbonate resin having a recurring unit represented by the following formula:

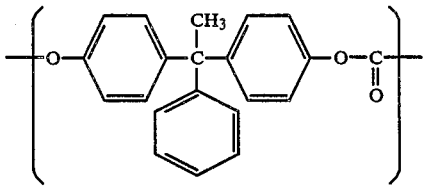

is dissolved in a solvent such as toluene and the solution is coated on a base film and dried to form a heat-resistant lubricating layer. If necessary, a phosphate ester compound may be added to this layer as the constituent thereof and this is also a preferred embodiment. Another exemplary heat-resistant lubricating layer is composed of a photocurable acrylic resin, silicon oil, fine particulate silica, etc.

The prepared ink may be coated on the base film by any suitable means such as a reverse roll coater, a gravure coater, a rod coater or an air-doctor coater. The ink may be deposited to provide a coating having a thickness of 0.1 to 5 μm on a dry basis (see Yuji Harazaki, "Coating Systems", published by Maki Shoten, 1979).

If necessary, an adhesive layer made of resins such as polyester resins, acrylic resins, urethane resins or polyvinyl alcohol resins, taken either individually or in admixtures, may be formed between the base film and the dye layer.

A thermal head is the most common heating means for use with the thermal dye transfer sheet of the present invention but other heating media can also be used, including infrared radiation and laser light. The thermal dye transfer sheet of the present invention may be designed as a current impressable type which employs a base film that is adapted to generate heat upon application of an electric current.

The following examples are provided for the purpose of further illustrating the present invention but are in no way to be taken as limiting.

EXAMPLE 1

(a) Ink Preparation

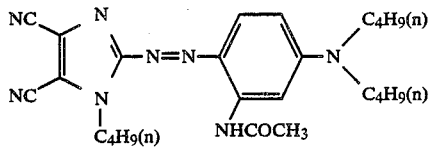

(A)

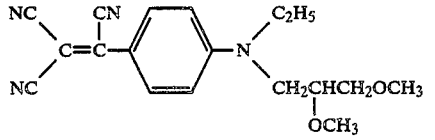

(B)

| | |
|---|---|
| Dye (A) | 3.0 g |
| Dye (B) | 3.0 g |
| Acetyl cellulose (L-30 of Daicel Chemical Industries, Ltd.) | 10.0 g |
| Methyl ethyl ketone | 80.0 g |
| Total | 96.0 g |

A mixture of the composition shown above was treated in a paint conditioner for 10 minutes to prepare ink.

(b) Preparation of Transfer Sheet

The ink was wire-bar coated on a polyethylene terephthalate film 6 μm thick that had been provided with a heat-resistant lubricating layer on its back surface. By drying the coating (dry thickness, ca. 1 μm), a transfer sheet was prepared. The heat-resistant lubricating layer on the polyethylene terephthalate film was formed by the following method: a solution consisting of 8 parts by weight of a polycarbonate resin having a recurring unit of the formula:

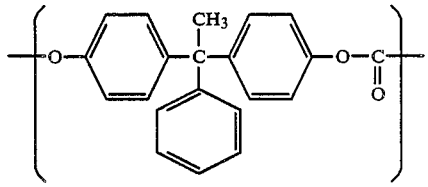

1 part by weight of a phosphate ester based surfactant (Plysurf A-208B of Dai-ichi Kogyo Seiyaku Co., Ltd.) and 91 parts by weight of toluene was coated on the base film and dried to give a dry thickness of ca. 0.5 μm.

(c) Preparation of Image-Receiving Sheet

A solution consisting of 10 parts of a saturated polyester resin (TP-220 of The Nippon Synthetic Chemical Industry Co., Ltd.), 0.5 parts of amino-modified silicon (KF 393 of Shin-Etsu Chemical Co., Ltd.), 15 parts of methyl ethyl ketone and 15 parts of xylene was wire-bar coated on synthetic paper (Yupo FPG 150 of Oji Yuka Synthetic Paper Co., Ltd.) and dried (dry thickness, ca. 5 μm). By subsequent heat treatment in an oven at 100° C. for 30 minutes, an image-receiving sheet was prepared.

(d) Transfer Recording

The transfer sheet was superposed on the image-receiving sheet in such a way that the ink-coated surface was placed in contact with the latter. When recording was performed with a thermal head under the conditions set forth below, recording characteristics as shown in FIG. 1 were obtained.

Recording Conditions

Line density for primary and auxiliary scanning: 6 dots/mm

Recording power: 0.4 W/dot

Head heating time: 0–10 msec

Color density was measured with a densitometer, Model TR-927 of Macbeth Inc., U.S.A.

(e) Lightfastness Test

The record obtained (color density, ca. 1.0) was subjected to a lightfastness test with a carbon arc fadeometer (product of Suga Test Instruments Co., Ltd.) at a black panel temperature of 63°±2° C. After exposure for 80 hours, the degree of discoloration or fading that had occurred was measured in terms of ΔE(L*a*b*) and the results are shown in Table 1. [As regarding ΔE(L*a*b*) the reference is made to JIS, Z-8729]

COMPARATIVE EXAMPLE 1-1

Ink was prepared as in Example 1 except that only dye (A) was incorporated in an amount of 6 g. Subsequently, a transfer sheet and an image-receiving sheet were prepared and transfer recording performed as in Example 1. The recording characteristics obtained are shown in FIG. 1. The results of the lightfastness test conducted on the record obtained are shown in Table 1.

COMPARATIVE EXAMPLE 1-2

Ink was prepared as in Example 1 except that only dye (B) was incorporated in an amount of 6 g. Subsequently, a transfer sheet and an image-receiving sheet were prepared and transfer recording performed as in Example 1. The recording characteristics obtained are shown in FIG. 1. The results of the lightfastness test conducted on the record obtained are shown in Table 1.

TABLE 1

Results of the Lightfastness Test

| Run No. | The degree of discoloration or fading (ΔE) |
|---|---|
| Example 1 | 3.71 |
| Comparative Example 1-1 | 2.19 |
| Comparative Example 1-2 | 18.22 |

EXAMPLE 2

Ink was prepared as in Example 1 except that dyes (A) and (B) were replaced by dyes (C) and (D), whose formulas are shown below. Subsequently, a transfer sheet and an image-receiving sheet were prepared and transfer recording and a lightfastness test conducted as in Example 1. The results are shown in Table 2.

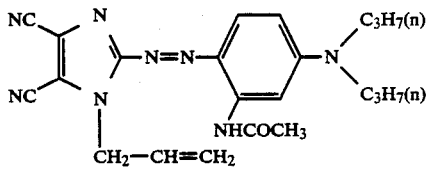

(C)

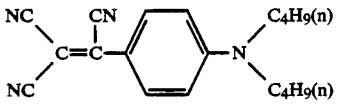

(D)

COMPARATIVE EXAMPLE 2-1

Ink was prepared as in Example 2 except that only dye (C) was used in an amount of 6 g. Subsequently, a transfer sheet and an image-receiving sheet were prepared and transfer recording and a lightfastness test conducted as in Example 2. The results are shown in Table 2.

COMPARATIVE EXAMPLE 2-2

Ink was prepared as in Example 2 except that only dye (D) was used in an amount of 6 g. Subsequently, a transfer sheet and an image-receiving sheet were prepared and transfer recording and a lightfastness test conducted as in Example 2. The results are shown in Table 2.

EXAMPLE 3

Ink was prepared as in Example 1 except that dyes (A) and (B) were replaced by dyes (E) and (F) having the structural formulas shown below. Subsequently, a transfer sheet and an image-receiving sheet were prepared and transfer recording and a lightfastness test conducted as in Example 1. The results are shown in Table 2.

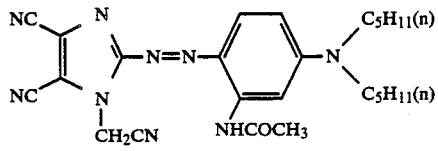

(E)

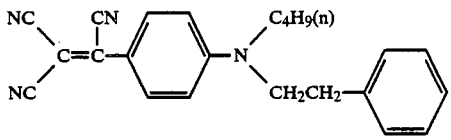

(F)

COMPARATIVE EXAMPLE 3-1

Ink was prepared as in Example 3 except that only dye (E) was used in an amount of 6 g. Subsequently, a transfer sheet and an image-receiving sheet were prepared and transfer recording and a lightfastness test conducted as in Example 3. The results are shown in Table 2.

COMPARATIVE EXAMPLE 3-2

Ink was prepared as in Example 3 except that only dye (F) was used in an amount of 6 g. Subsequently, a transfer sheet and an image-receiving sheet were prepared and transfer recording and a lightfastness test conducted as in Example 3. The results are shown in Table 2.

EXAMPLE 4

Ink was prepared as in Example 1 except that dyes (A) and (B) were replaced by dyes (G) and (H) having the structural formulas shown below. Subsequently, a transfer sheet and an image-receiving sheet were prepared and transfer recording and a light-fastness test conducted as in Example 1. The results are shown in Table 2.

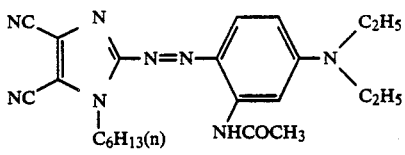

(G)

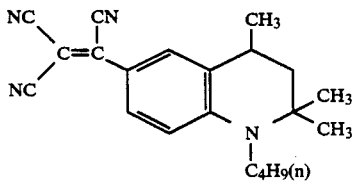

(H)

COMPARATIVE EXAMPLE 4-1

Ink was prepared as in Example 4 except that only dye (G) was used in an amount of 6 g. Subsequently, a transfer sheet and an image-receiving sheet were prepared and transfer recording and a lightfastness test conducted as in Example 4. The results are shown in Table 2.

COMPARATIVE EXAMPLE 4-2

Ink was prepared as in Example 4 except that only dye (H) was used in an amount of 6 g. Subsequently, a transfer sheet and an image-receiving sheet were prepared and transfer recording and a lightfastness test conducted as in Example 4. The results are shown in Table 2.

TABLE 2

| Run No. | results of Transfer Recording and Lightfastness Test: Transfer recording (recorded color density*) | Lightfastness test (discoloration or fading = ΔE) |
|---|---|---|
| Example 2 | 2.40 | 4.50 |
| Comparative Example 2-1 | 2.05 | 2.20 |
| Comparative Example 2-2 | 2.45 | 25.50 |
| Example 3 | 2.20 | 3.10 |
| Comparative Example 3-1 | 1.95 | 1.50 |
| Comparative Example 3-2 | 2.25 | 20.05 |
| Example 4 | 2.25 | 4.15 |
| Comparative Example 4-1 | 2.02 | 2.21 |
| Comparative Example 4-2 | 2.30 | 35.50 |

*Density of color recorded with an electric current applied to the thermal head for 10 m sec.

While the invention has been described in detail and with reference to specific embodiments thereof, it will be apparent to one skilled in the art that various changes and modifications can be made therein without departing from the spirit and scope thereof.

What is claimed is:

1. A thermal magenta-dye transfer sheet that comprises a base film having thereon a dye layer comprising a magenta dye dispersed in a binder, said dye being a mixture of dyes represented by the following general formulas (I) and (II):

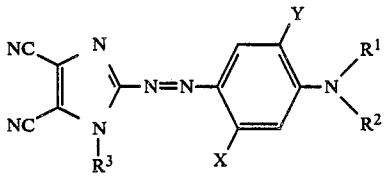

(I)

(where X is a hydrogen atom, a lower alkyl group, a lower alkoxy group, a formylamino group, a lower alkylcarbonylamino group, a lower alkylsulfonylamino group or a lower alkoxy-carbonylamino group; Y is a hydrogen atom, a lower alkyl group, a lower alkoxy group or a halogen atom; and $R^1$, $R^2$ and $R^3$ each represents a hydrogen atom, a substituted or unsubstituted alkyl group, a cycloalkyl group, an allyl group or a substituted or unsubstituted aryl group)

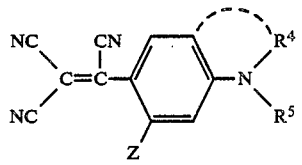

(II)

(where Z is a hydrogen atom or a lower alkyl group; and $R^4$ and $R^5$ each represents a hydrogen atom, a substituted or unsubstituted alkyl group, a cycloalkyl group, an allyl group, or a substituted or unsubstituted aryl group, and $R^4$ may also form a heterocyclic 6-membered ring by being bonded to a carbon atom adjacent to the carbon binding to the nitrogen atom which is bonded to the benzene ring).

2. A thermal magenta-dye transfer sheet according to claim 1 wherein X in the general formula (I) is a hydrogen atom, a methyl group, a methoxy group, a formylamino group, an alkylcarbonyl-amino group having 2–5 carbon atoms, an alkylsulfonylamino group having 1–4 carbon atoms, an alkoxycarbonylamino group having 2–5 carbon atoms; Y is a hydrogen atom, a methyl group, a methoxy group, a chlorine atom or a fluorine atom; $R^1$ and $R^2$ is a substituted or unsubstituted alkyl group having 1–12 carbon atoms or an allyl group; and $R^3$ is a substituted or unsubstituted alkyl group of $C_{1-12}$ or an allyl group.

3. A thermal magenta-dye transfer sheet according to claim 1 wherein X in the general formula (I) is a hydrogen atom, a methyl group, a methoxy group, a formylamino group or an alkylcarbonyl-amino group of $C_{2-5}$; Y is a hydrogen atom; $R^1$ and $R^2$ each represents an allyl group, an alkyl group of $C_{1-8}$, a benzyl group, a phenethyl group, a hydroxyl-, a halogen- or a cyano-substituted alkyl group of $C_{2-8}$ or an alkoxyalkyl group of $C_{3-8}$; and $R^3$ is an alkyl group of $C_{1-8}$, an allyl group, a cyanomethyl group, a cyanoethyl group, an alkoxycarbonylmethyl group having an alkoxy group of $C_{1-8}$, or an alkoxycarbonylethyl group having an alkoxy group of $C_{1-8}$.

4. A thermal magenta-dye transfer sheet according to claim 1 where X in the general formula (I) is an acetylamino group or a formylamino group; Y is a hydrogen atom; $R^1$ and $R^2$ each represents an alkyl group of $C_{1-8}$ or an alkoxyalkyl group of $C_{3-8}$; and $R^3$ is an alkyl group of $C_{1-8}$, an alkoxyalkyl group of $C_{3-8}$, a cyanomethyl group or an allyl group.

5. A thermal magenta-dye transfer sheet according to claim 1 wherein X in the general formula (I) is an acetylamino group or a formylamino group; Y is a hydrogen atom; $R^1$ and $R^2$ are each an alkyl group of $C_{1-8}$ and $R^3$ is an alkyl group of $C_{1-8}$, a cyano-methyl group or an allyl group.

6. A thermal magenta-dye transfer sheet according to claim 1 wherein the dye represented by the general formula (II) is one which is represented by the following general formula (III) or (IV):

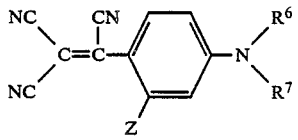

(III)

[where $R^6$ and $R^7$ each represents an alkyl group of $C_{1-12}$ which may be substituted by a cyano group, a halogen atom, an alkoxy group, an alkoxyalkoxy group, an aryloxy group, an allyloxy group, an aralkyloxy group, an aryl group, a hydroxyl group, a furyl group, a tetrahydrofuryl group, an alkoxycarbonyl group, an allyloxycarbonyl group or an acyloxy group, or an allyl group; and Z has the same meaning as defined in formula (II)]; or (IV)

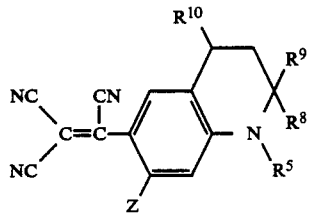

[where $R^8$, $R^9$ and $R^{10}$ each represents a hydrogen atom or a methyl group; and Z and $R^5$ have the same meanings as defined in formula (II)].

7. A thermal magenta-dye transfer sheet according to claim 6 wherein Z in the general formula (III) is a hydrogen atom or a methyl group, and $R^6$ and $R^7$ are each an alkyl group of $C_{1-8}$, an alkoxy-alkyl group of $C_{3-8}$, a benzyl group, or a β-phenylethyl group.

8. A thermal magenta-dye transfer sheet according to claim 6 wherein Z in the general formula (III) is a hydrogen atom, and $R^6$ and $R^7$ are each an alkyl group of $C_{1-8}$, an alkoxyalkyl group of $C_{3-8}$, or a β-phenylethyl group.

9. A thermal magenta-dye transfer sheet according to claim 6 wherein Z in the general formula (IV) is a hydrogen atom or a methyl group; $R^5$ is an alkyl group of $C_{1-8}$, an alkoxyalkyl group of $C_{3-8}$, a benzyl group or a β-phenylethyl group; and $R^8$, $R^9$ and $R^{10}$ are each hydrogen atom or a methyl group.

10. A thermal magenta-dye transfer sheet according to claim 6 wherein Z in the general formula (IV) is a hydrogen atom; $R_5$ is an alkyl group of $C_{1-8}$, an alkoxyalkyl group of $C_{3-8}$ or a β-phenylethyl group; and $R^8$, $R^9$ and $R^{10}$ are each hydrogen atom or a methyl group.

11. A thermal magenta-dye transfer sheet according to claim 1 wherein at least one dye of the general formula (I) wherein X is an acetylamino group or a formylamino group, Y is a hydrogen atom, $R^1$ and $R^2$ are each an alkyl group of $C_{1-8}$ or an alkoxyalkyl group of $C_{3-8}$ and $R^3$ is an alkyl group of $C_{1-8}$, an alkoxyalkyl group of $C_{3-8}$, a cyanomethyl group or an allyl group, is used in combination with at least one dye of the general formula (III) wherein Z is a hydrogen atom or a methyl group, and $R^6$ and $R^7$ are each an alkyl group of $C_{1-8}$, an alkoxyalkyl group of $C_{3-8}$, a benzyl group or β-phenylethyl group.

12. A thermal magenta-dye transfer sheet according to claim 1 wherein at least one dye of the general formula (I) wherein X is an acetylamino group or a formylamino group, Y is a hydrogen atom, $R^1$ and $R^2$ are each an alkyl group of $C_{1-8}$ or an alkoxyalkyl group of $C_{3-8}$, and $R^3$ is an alkyl group of $C_{1-8}$, an alkoxyalkyl group of $C_{3-8}$, a cyanomethyl group or an allyl group, is used in combination with at least one dye of the general formula (IV) wherein Z is a hydrogen atom or methyl group, $R^5$ is an alkyl group of $C_{1-8}$, an alkoxyalkyl group of $C_{3-8}$, a benzyl group or a β-phenylethyl group, and $R_8$, $R^9$ and $R^{10}$ are each hydrogen atom or a methyl group.

13. A thermal magenta-dye transfer sheet according to claim 1 wherein at least one dye of the general formula (I) wherein X is an acetylamino group or a formylamino group, Y is a hydrogen atom, $R^1$ and $R^2$ are each an alkyl group of $C_{1-8}$, and $R^3$ is an alkyl group of $C_{1-8}$, a cyanomethyl group or an allyl group, is used in combination with at least one dye of the general formula (III) wherein Z is a hydrogen atom, and $R^6$ and $R^7$ are each an alkyl group of $C_{1-8}$, an alkoxyalkyl group of $C_{3-8}$ or a β-phenylethyl group.

14. A thermal magenta-dye transfer sheet according to claim 1 wherein the weight ratio of the dye represented by the general formula (I) to the dye represented by the general formula (II) is within the range of from 1:5 to 5:1.

15. A thermal magenta-dye transfer sheet according to claim 1 wherein the base film has a thickness of 3–50 μm.

16. A thermal magenta-dye transfer sheet according to claim 1 wherein the dye layer has a thickness of 0.1–5 μm on a dry basis.

17. A thermal magenta-dye transfer sheet according to claim 1 wherein the binder is a water-soluble resin selected from the group consisting of cellulose resins, acrylate resins and starches, or a resin that is soluble in organic solvents which is selected from the group consisting of (meth)acrylic resins, polystyrene, polycarbonate, polysulfone, polyether sulfone, polyvinyl butyral, ethyl cellulose, acetylpropionyl cellulose, acetyl cellulose. As resins, ABS resins, polyester resins and phenoxy resins.

18. A thermal magenta-dye transfer sheet according to claim 1 wherein the dye layer has incorporated therein a material selected from the group consisting of an organic or inorganic nonsublimable fine powder, a dispersant, an antistatic agent, an anti-blocking agent, an antifoaming agent, an antioxidant, and a viscosity modifier.

19. In a process of forming a dye transfer image comprising imagewise-heating a thermal dye transfer sheet comprising a base film having thereon a dye layer comprising a magenta-dye dispersed in a binder and transferring a magenta-dye image to a dye-receiving sheet to form said magenta transfer image, the improvement wherein said magenta dye is a mixture of two dyes represented by the following general formulas [I] and [II].:

(I)

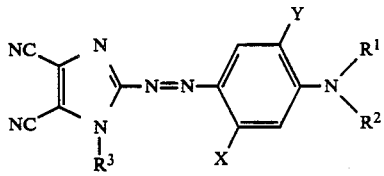

(where X is a hydrogen atom, a lower alkyl group, a lower alkoxy group, a formylamino group, a lower alkylcarbonylamino group, a lower alkylsulfonylamino group or a lower alkoxy-carbonylamino group; Y is a hydrogen atom, a lower alkyl group a lower alkoxy group or a halogen atom; and $R^1$, $R^2$ and $R^3$ each represents a hydrogen atom, a substituted or unsubstituted alkyl group, a cycloalkyl group, an allyl group or a substituted or unsubstituted aryl group); and (II)

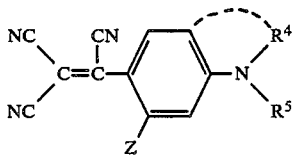

(where Z is a hydrogen atom or a lower alkyl group); and $R^4$ and $R^5$ each represents a hydrogen atom, a substituted or unsubstituted alkyl group, a cycloalkyl group, an allyl group, or a substituted or unsubstituted aryl group, and $R^4$ may also form a heterocyclic 6-members ring by being bonded to a carbon atom adjacent to the carbon binding to the nitrogen atom which is bonded to the benzene ring.

* * * * *